United States Patent [19]

Nickolay

[11] Patent Number: 4,565,062

[45] Date of Patent: Jan. 21, 1986

[54] THREAD AND YARN END RETRIEVAL NOZZLE

[75] Inventor: Helmut Nickolay, Göppingen, Fed. Rep. of Germany

[73] Assignee: Zinser Textilmaschinen GmbH, Ebersbach, Fed. Rep. of Germany

[21] Appl. No.: 605,580

[22] Filed: Apr. 30, 1984

[30] Foreign Application Priority Data

May 3, 1983 [DE] Fed. Rep. of Germany ..... 3316108

[51] Int. Cl.[4] ..... D01H 13/00; D01H 15/00; B65H 54/22

[52] U.S. Cl. ..... 57/305; 57/279; 57/261; 242/35.6 E

[58] Field of Search ..... 57/261, 279, 305, 304; 242/35.6 E

[56] References Cited

U.S. PATENT DOCUMENTS

| | | | |
|---|---|---|---|
| 3,236,464 | 2/1966 | Wey | 242/35.6 E X |
| 3,464,640 | 9/1969 | Kupper | 242/35.6 E |
| 3,559,904 | 2/1971 | Raasch | 242/35.6 E |
| 3,637,148 | 1/1972 | Kupper | 242/35.6 E |
| 3,868,813 | 3/1975 | Vignon | 57/305 |
| 4,009,840 | 3/1977 | Muller | 242/35.6 E |
| 4,132,057 | 1/1979 | Weiss et al. | 242/35.6 E X |

FOREIGN PATENT DOCUMENTS

| | | |
|---|---|---|
| 2423493 | 11/1975 | Fed. Rep. of Germany . |
| 2543767 | 4/1977 | Fed. Rep. of Germany . |

*Primary Examiner*—John Petrakes

*Attorney, Agent, or Firm*—Karl F. Ross; Herbert Dubno

[57] ABSTRACT

A nozzle for liberating a broken yarn end from a yarn package in a spinning or twisting frame is either tiltable or has selectively actuatable orifices to alter the angle at which the jet or jets for dislodging the broken yarn end is trained to the yarn package. The change in the angle is effected during the course of package building and the liberated yarn end can be captured by a suction hood.

12 Claims, 5 Drawing Figures

THREAD AND YARN END RETRIEVAL NOZZLE

CROSS REFERENCE TO RELATED APPLICATION

This application is related to my commonly assigned copending application Ser. No. 602,325, filed Apr. 20, 1984 and entitled "YARN END BLOWING NOZZLE".

FIELD OF THE INVENTION

My present invention relates to a system of the type in which at least one jet or stream of air is trained against a body of coiled yarn, hereinafter referred to as a yarn package e.g. of a bobbin, cop or other unit, to release a free yarn end so that the latter can be captured, e.g. in a suction head or the like of a textile machine such as a spinning or twisting frame. More particularly, the invention relates to the nozzle for such a twisting or spinning frame which can effect the release of the broken yarn end.

BACKGROUND OF THE INVENTION

In ring spinning and other spinning or twisting frames and hence in textile machines generally it is known, e.g. from German Patent Document (Open Application) DE-OS No. 25 43 767, to provide an arrangement for releasing a broken yarn end and enabling the thus released yarn end to be captured by a suction head or bell.

Utilizing this system, the broken yarn end, which might otherwise hug the yarn package, can be freed to enable its capture in the aforedescribed manner so that, for example, the broken yarn end can be tied to the free end of another yarn.

In this earlier system, the nozzle which liberates the broken yarn end is provided in the form of a fork which partly embraces the bobbin or yarn package, i.e. extends at least in part therearound, and has widely separated orifices from which respective jets of compressed air can be trained upon the yarn package to free the broken yarn end.

Mention should also be made of a known device which has been described in German Pat. No. 24 23 493 in which a nozzle for directing a stream against a rotating textile package pneumatically releases the starting end of a yarn in which the nozzle is pivotally or swingably mounted about an axis parallel to the spindle, bobbin or package axis.

Experience has shown, with these earlier systems that when the broken yarn end is adherent to a frustoconical end of the yarn package or coil, these earlier systems are not always effective in enabling the release of the broken yarn end.

OBJECTS OF THE INVENTION

It is, therefore, the principal object of the present invention to provide an improved nozzle arrangement for a system of the type described, i.e. for the liberation of a broken yarn end and its capture.

Another object of this invention is to provide an arrangement having an improved yarn end release nozzle which is more effective for the release of the yarn end from the yarn package frustocone configuration than has been the case with earlier systems.

Yet another object of my invention is to provide an improved arrangement for the release and capture of a yarn end from a bobbin or other yarn package whereby the drawbacks of earlier systems are obviated.

SUMMARY OF THE INVENTION

These objects and others which will become apparent hereinafter are attained, in accordance with the present invention, in a device of the type described wherein a nozzle is trained against the frustoconical portion of a yarn package during the formation thereof and can direct at least one jet to an inclination at the axis of the spindle from which the yarn package is formed, but wherein the inclination of this nozzle and the jet with respect to the longitudinal axis of the yarn package is varied during the building of the yarn package.

Indeed, I have discovered that as the frustoconical formation of the yarn package changes in shape or dimension with the building of the yarn package or the core or sleeve of the bobbin, it is advantageous to modify the angle at which the jet is directed against the yarn package or, as stated otherwise, to modify the angle included between the jet and the axis of the bobbin in accordance with the bulge of the yarn package and the development of the frustocone. At different dimensions and configurations of the frustoconical portion of the yarn package, therefore, different angles of attack of the jet thereagainst are required for the optimum release of the broken yarn end.

Advantageously, in one embodiment of the invention the nozzle is mounted so as to pivot about an axis which is transverse to the axis of the spindle and hence the bobbin or spindle and to offset therefrom with the nozzle reaching towards the yarn package from its pivot axis, while means, e.g. a fluid responsive cylinder, is provided to swing the nozzle about this pivot axis.

According to a feature of the invention, this piston-and-cylinder arrangement can be actuated automatically in response to the development of the yarn package.

While the nozzle of the invention can be formed with a single passage, I have found it to be advantageous to provide the nozzle with a plurality of orifices and passages which are preferably closely spaced in accordance with the principles of my above-identified application which is hereby incorporated in its entirety by reference.

According to another embodiment of the invention, the nozzle is provided with a plurality of individual passages, and these passages are inclined at different angles with respect to the longitudinal axis and the spindle axis and indeed, I can selectively actuate or pressurize passages of a nozzle arrangement having a plurality of such passages with compressed air so that different passages generate jets at different angles selectively and indeed to adjust the passages oriented at different angles to the spindle or package axis which can be selectively actuated.

According to yet another feature of the invention, the nozzle may be subdivided into two portions, each of which is provided with a respective row of such passages and the passage of the two rows can be inclined at different angles to the spindle axis. The two portions or passages can be selectively pressurized by a three-position valve according to another feature of this invention.

Still another feature of the invention is manifested in the way in which the angle is oriented in response to the building of the yarn body or package. Hence during the initial formation of the bulge of the yarn package the jet will be directed with a greater inclination with respect to the spindle axis than during normal package building. Consequently, during the formation of the frustoconical projecting portion of the coil the nozzle can be tilted so that the incorporation of the compressed air jets is such that they include angles between 20° and 40° with the spindle axis, preferably between 25° and 35° while the angle is reduced by 5°–15° for the normal package formation, i.e. for the coiling of the yarn over the cylindrical portion of the package.

BRIEF DESCRIPTION OF THE DRAWING

The above and other objects, features and advantages of the present invention will become more readily apparent from the following description, reference being made to the accompanying drawing, in which.

SPECIFIC DESCRIPTION

Figure 1:
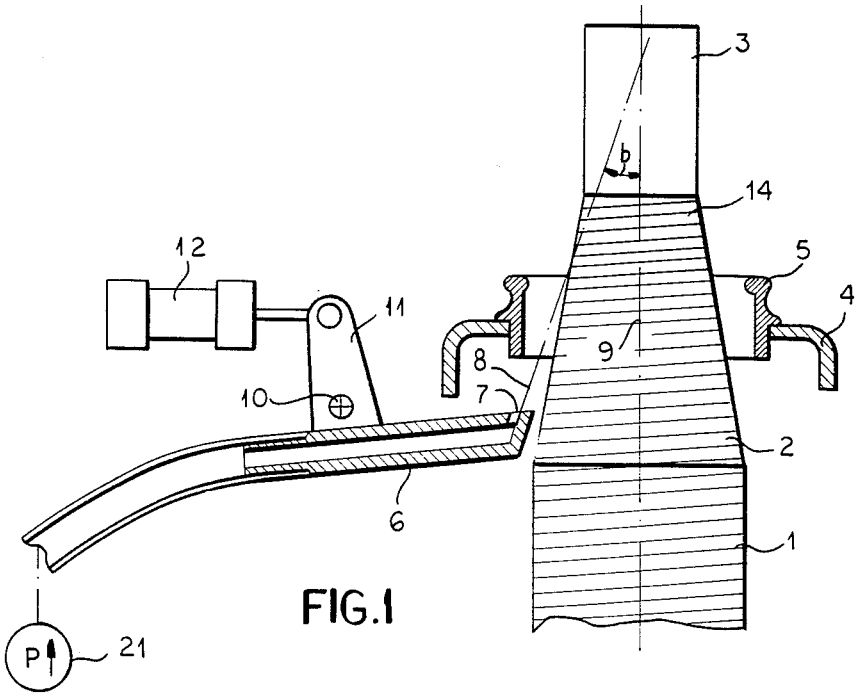
FIG. 1 is a diagrammatic side-elevational view, partly broken away, of a portion of a ring-spinning frame illustrating the effect at the frustoconical end portion of a yarn package utilizing a pivotal nozzle according to the invention.

In FIG. 1 I have shown a yarn package 1 which is wound upon a cone or sleeve 3 and forms a bobbin having a frustoconical portion 2 which converges toward the surface of the sleeve from the outermost portion of the bobbin. This bobbin can be formed on any spinning or twisting frame and in the case illustrated is shown in a ring spinning frame having a ring rail 4 with a spinning or twisting ring 5 along which a traveler (not shown) can move. Generally the bobbin sleeve is mounted on a spindle whose axis has been indicated at 9 and can be driven by a whorl or a spindle rail which also has not been illustrated but is conventional in the art.

The yarn package 1 is therefore mounted upon the sleeve 3 in the twisting or spinning frame in a conventional manner.

Figure 4:
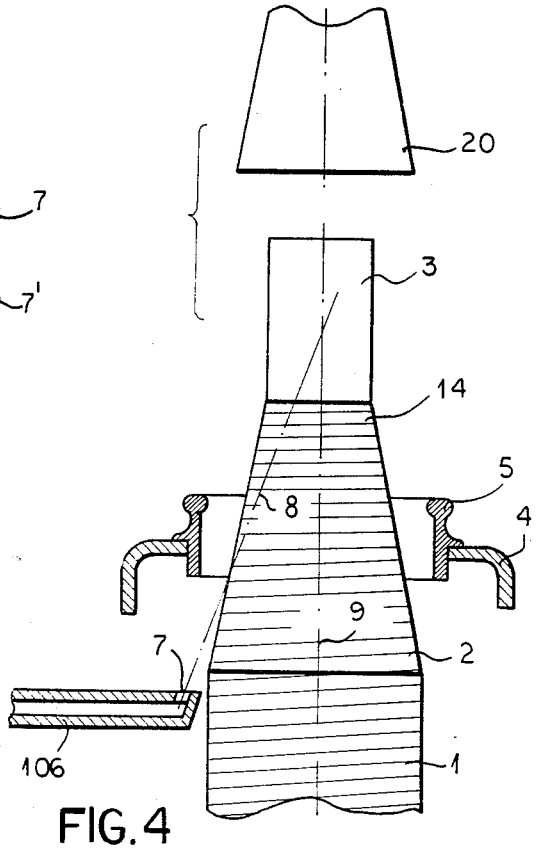
FIG. 4 is a view similar to FIG. 1 showing the effect during normal coil building.

Above the spindle, a yarn end collection hood 20 can be provided as has been shown in FIG. 4 and is connected to a suction source so that, when a yarn end is blown free from the yarn package, it can be drawn into the hood or captured so that it can, for example, be tied to another yarn end, also by conventional means.

According to the invention, below the ring rail 4, a nozzle 6 is provided for directing at least one jet of compressed air, e.g. from compressed air source 21, against the upper end of the yarn package of coil of yarn or the tube 3, to free this yarn end which, upon yarn breaking, tends to hug the package.

The nozzle 6 is provided with at least one orifice or passage 7 oriented so that its axis 8, which represents the axis of its jet, is inclined at an angle to the axis 9 of the spindle and the package.

The nozzle 6, which extends generally radially toward the yarn package, need not embrace it and is pivotally mounted, e.g. on the rail 4 or some other part of the spinning or twisting frame, for swinging movement about a pivotal axis 10 and can be tilted about this axis 6 by a lever 11 which is articulated to the piston rod of an actuating unit shown at 12, i.e. a piston-and-cylinder unit which can be pneumatically actuated.

Figure 2:
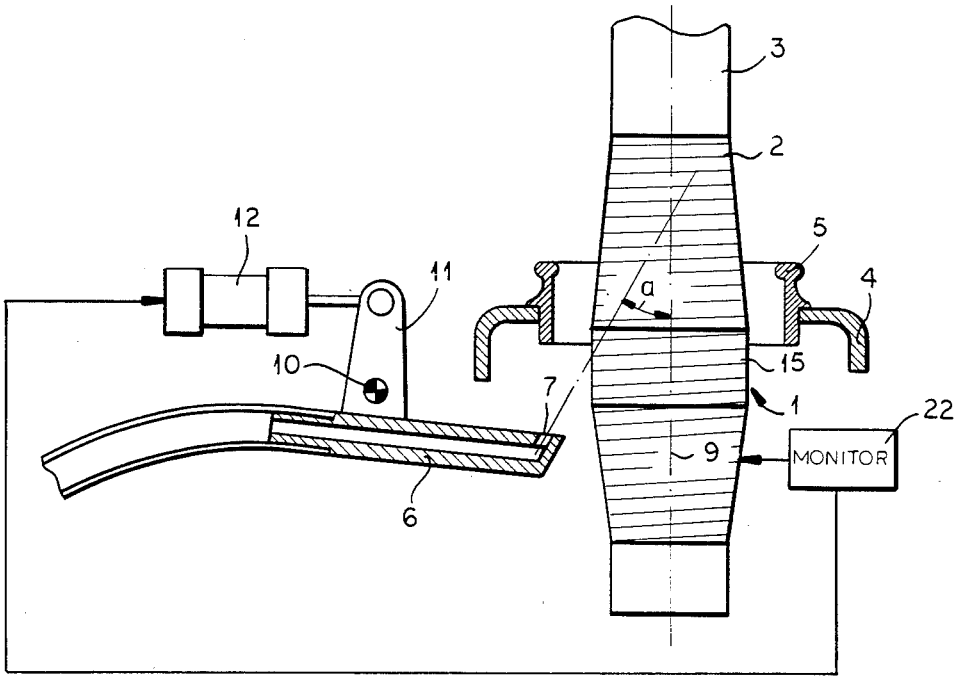
FIG. 2 shows the effect in a similar sectional view in the region of the bulge during the beginning of yarn package building.

As a comparison of FIGS. 1 and 2 will show, the actuator 12 is thus able to change the angle a or b included between the jet and the axis and hence the angle with which the jet impinges upon the yarn package, during the course of package building or the formation of the yarn package.

During normal package building, i.e. winding of the yarn after the initial configuration has been imparted to the yarn package a comparatively shallow angle b is desirable as has been illustrated in FIG. 1. FIG. 2, however, shows that during the initial formation of the package 3 the bulge 15 is formed, the preferred angle is somewhat greater as indicated at a.

The tilt from angle a to angle b is effected during the progress of package building and can be controlled by a monitor which has been illustrated at 22 in FIG. 2 and which can sense the package shape directly or can be a monitor of the length of the yarn previously wound upon the package.

During formation of the bulge 15 in FIG. 2, the preferred angle $\alpha$ ranges between 20° and 40° and must preferably be between 25° and 30° whereas the angle b, during the remainder of package building, i.e. for the balance of the coiling operation, can be 5° to 15° less than the angle used initially.

Figure 3:
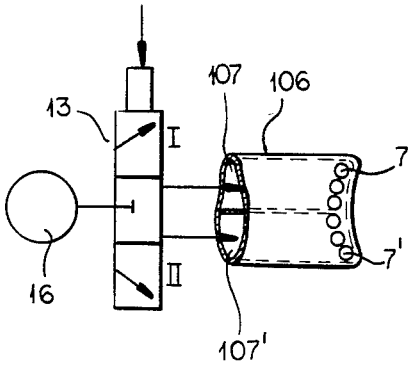
FIG. 3 is a plan view diagrammatically illustrating the feeding of the nozzle with compressed air in another embodiment of the invention.
Figure 5:
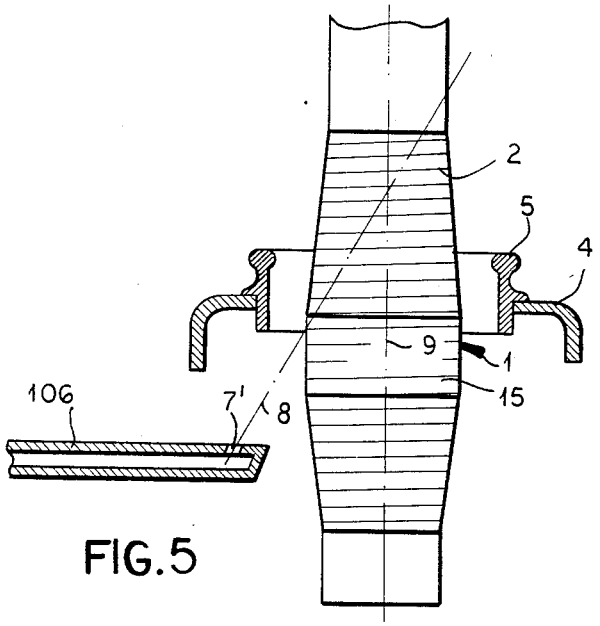
FIG. 5 is a view similar to FIG. 2 but illustrating the use of the nozzle of FIG. 3 in the region of the bulge.

In FIGS. 3–5, I have shown another embodiment of the invention wherein the nozzle 106 is not required to tilt.

As can be seen from FIG. 3, this nozzle is provided with two sets of orifices or passage 7. 7' is in closely spaced relationship and in a row along an arc. Each of these sets of passages communicate with a respective channel 107 and 107' in the nozzle and these channels are separated from one another. The nozzles 7' are oriented at a greater angle to the axis as shown in FIG. 5 while the orifices 7 are oriented to the shallower angle.

During the formation of the bulge 15, therefore, a three-position valve 13 (position II) can connect the compressed air source 16 to the passage 107' so that the jets directed to the end of the yarn package have the greater inclination.

During the remainder of the package building operation, when necessary, the valve 13 connects the passage 107 to the compressed air source (position I rather than position II) so that the shallower air jets are effective. The valve 13 can be controlled by a monitor as shown in FIG. 2 to switch over between different inclinations in the course of package building. Initially, therefore, the jet may impinge upon the yarn package at an angle of 30° with the nozzle 7' being correspondingly oriented wheres during the later stage of package formation the orifices 7 at an angle of 20° become effective. Consequently, the stronger jet effect is applied when there is less tendency to dislodge previous turns of the yarn package, i.e. for the flatter cone while the effective of the jet is somewhat less with the steeper cone and where there is a greater tendency to release previously formed turns.

Naturally, in the embodiment of FIGS. 1 and 2, the nozzle can also be provided with a plurality of orifices and/or two or more groups of orifices to contribute to the selection of the orientation of the jets.

I claim:

1. In a textile machine for forming a yarn package, a suction hood at one end of said yarn package for capturing a loose yarn end and a nozzle from which a jet of air flows directed against said yarn package for releasing a yarn end for capture by said hood, the improvement which comprises:

means for pivotally mounting said nozzle for tilting movements about an axis transverse to an axis of said yarn package, which means is capable of selectively varying the angle at which a jet of air is trained by said nozzle against said yarn package during the course of building the yarn package.

2. The improvement defined in claim 1 wherein the angle of said jet is varied in accordance with the change in the angle of a frustoconical portion of said yarn package.

3. The improvement defined in claim 1, further comprising:

means for automatically tilting said nozzle about said transverse axis.

4. The improvement defined in claim 3 wherein said means for automatically tilting said nozzle includes a piston-and-cylinder unit operatively connected to said nozzle.

5. The improvement defined in claim 1 wherein said nozzle is provided with at least two orifices adapted to train respective jets against said yarn package at different angles, and means for selectively feeding said orifices with compressed air.

6. The improvement defined in claim 5 wherein said orifices are disposed adjacent one another and are alternatively supplied with air.

7. The improvement defined in claim 6 wherein said orifices are each members of a respective row of closely spaced orifices training respective jets of air to corresponding angles along said package.

8. The improvement defined in claim 7 wherein a three-position valve is provided to selectively feed compressed air to said orifices.

9. The improvement defined in claim 1 wherein said jet is trained at said yarn package at a greater angle during the initial formation of the package and is then trained at a shallower angle thereagainst during subsequent package formation.

10. The improvement defined in claim 9 wherein said greater angle is between 20° and 40°.

11. The improvement defined in claim 10 wherein said shallower angle is between 5° and 15° less than said greater angle.

12. The improvement defined in claim 10 wherein said greater angle is between 25° and 35°.

* * * * *